US011229919B2

(12) United States Patent
Wu et al.

(10) Patent No.: US 11,229,919 B2
(45) **Date of Patent: *Jan. 25, 2022**

(54) WATER OUTLET DEVICE

(71) Applicant: XIAMEN SOLEX HIGH-TECH INDUSTRIES CO., LTD., Xiamen (CN)

(72) Inventors: Shilong Wu, Xiamen (CN); Fengde Lin, Xiamen (CN); Wenxing Chen, Xiamen (CN); Qihua Fan, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 189 days.

This patent is subject to a terminal disclaimer.

(21) Appl. No.: 16/509,275

(22) Filed: Jul. 11, 2019

(65) Prior Publication Data

US 2020/0038885 A1 Feb. 6, 2020

(30) Foreign Application Priority Data

Aug. 1, 2018 (CN) ..... 201810866525.1

(51) Int. Cl.
*B05B 1/16* (2006.01)
*B05B 1/18* (2006.01)

(52) U.S. Cl.
CPC ..... *B05B 1/16* (2013.01); *B05B 1/18* (2013.01)

(58) Field of Classification Search
CPC ..... B05B 1/16; B05B 1/18; B05B 3/04; B05B 3/16; B05B 1/1663
See application file for complete search history.

(56) References Cited

U.S. PATENT DOCUMENTS 4,018,385 A * 4/1977 Bruno ..... B05B 1/083 239/381
2006/0157590 A1* 7/2006 Clearman ..... B05B 3/0418 239/383

(Continued)

FOREIGN PATENT DOCUMENTS

CN 203578043 U 5/2014

*Primary Examiner* — Qingzhang Zhou
(74) *Attorney, Agent, or Firm* — Cooper Legal Group, LLC

(57) ABSTRACT

The invention discloses a water outlet device, which includes a shell part, a movable plate and a driving mechanism. The shell part is provided with a water outlet part. The driving mechanism connects the movable plate to drive the movable plate to slide relative to the water outlet part between the first position and the second position; the water outlet part has a water outlet, and the water outlet has a first inner side wall and a second inner side wall; the movable plate is provided with an insertion part, which has a first outer side wall and a second outer side wall side wall, and the insertion part is inserted into the water outlet; wherein: the movable plate is located in the first position: the water outlet forms a first water outlet channel sandwiched between the first outer side wall and the first inner side wall; the movable plate is located in the second position: the water outlet forms a second water outlet channel sandwiched between the second outer side wall and the second inner side wall, that is to say, the movable plate circulation makes the outlet water from the first water outlet channel to the second water outlet channel circulate to produce mixed water spray.

15 Claims, 9 Drawing Sheets

(56) References Cited

U.S. PATENT DOCUMENTS

2006/0219821 A1* 10/2006 Okuma ..... B05B 1/18
239/556
2010/0127096 A1* 5/2010 Leber ..... B05B 3/04
239/101

* cited by examiner

WATER OUTLET DEVICE

TECHNICAL FIELD

The invention relates to the field of sanitary ware, in particular to a water outlet device.

BACKGROUND TECHNOLOGY

The existing water outlet device, such as CN203578043U, includes a body component and a water outlet component, the body component includes a shower body with a water inlet; the water outlet component comprises a surface cover, a water outlet jacket matched with the surface cover and a decorative cover. The shower also comprises an intermittent water outlet mechanism, which is arranged between the shower body and the surface cover. The intermittent water outlet mechanism comprises a movable plate with two or more groups of water outlets. The surface cover has a water outlet cavity for the movable plate to move left and right. The third and fourth water outlets matching the first and second water outlets on the movable plate are provided, wherein, the movable plate abuts the bottom of the water outlet cavity, and moves left and right to make the first and second water outlets alternate with the third and fourth water outlets of the movable plate. The activity of the movable plate is switched between the two water outlet states, one water outlet state is that the first water outlet and the third water outlet are connected, and the other water outlet state is that the second water outlet and the fourth water outlet are connected. That is, one water outlet state is the third outlet discharge water, and the other water outlet state is the fourth outlet discharge water, different water outlet states, different water outlets discharge water, resulting in too many water, or the outlet area is small, and the structure is complicated.

SUMMARY OF THE INVENTION

In order to solve the above problems existing in the prior art, the invention provides a water outlet device to solve the technical problems existing in the water outlet device in the background technology.

One of the technical schemes provided by the invention is as follows: A water outlet device, wherein comprises a shell part, a movable plate and a driving mechanism. The shell part is provided with a water outlet part. The driving mechanism connects the movable plate to drive the movable plate to slide relative to the water outlet part between the first position and the second position; the water outlet part has a water outlet, and the water outlet has a first inner side wall and a second inner side wall; the movable plate is provided with an insertion part, which has a first outer side wall and a second outer side wall side wall, and the insertion part is inserted into the water outlet; wherein: the movable plate is located in the first position: the water outlet forms a first water outlet channel sandwiched between the first outer side wall and the first inner side wall; the movable plate is located in the second position: the water outlet forms a second water outlet channel sandwiched between the second outer side wall and the second inner side wall.

In an embodiment: the two inner side walls of the water outlet facing along the sliding direction of the movable plate are the first inner side wall and the second inner side wall respectively; the movable plate is provided with an insertion part, the two outer side walls of the insertion part facing along the sliding direction of the movable plate are the first outer side wall and the second outer side wall, respectively.

In an embodiment: when the movable plate is located in the first position: the second outer side wall and the second inner side wall are adjacent to each other; when the movable plate is located in the second position: the first outer side wall and the first inner side wall are adjacent to each other.

In an embodiment: the water outlet angle of the first water outlet channel is different from that of the second water outlet channel.

In an embodiment: the first outer side wall is parallel to the first inner side wall of the movable plate in the first position, and the second outer side wall are parallel to the second inner side wall of the movable plate in the second position.

In an embodiment: the first outer side wall and the second outer side wall cooperate to form an octagonal shape with large front and small back, the first inner side wall and the second inner side wall cooperate to form an octagonal shape with large front and small back.

In an embodiment: the angle between the first outer side wall and the movable plate sliding direction is 80-90 degrees, and the angle between the second outer side wall and the movable plate sliding direction is 90-100 degrees.

In an embodiment: the angle between the first outer side wall and the second outer side wall is 0-10 degrees, and the angle between the first inner side wall and the second inner side wall is 0-10 degrees.

In an embodiment: the two inner side walls of the water outlet facing each other perpendicular to the sliding direction of the movable plate are the third inner side wall and the fourth inner side wall, respectively, the two outer side walls of the insertion part facing each other perpendicular to the sliding direction of the movable plate are the third outer side wall and the fourth outer side wall, respectively.

In an embodiment: the angle between the third inner side wall and the fourth inner side wall is 0-20 degrees, and the angle between the third outer side wall and the fourth outer side wall is 0-20 degrees.

In an embodiment: the third outer side wall and the third inner side wall are abutted, and the fourth outer side wall and the fourth inner side wall are abutted.

In an embodiment: the water outlet part has a back side and a front side, and the water outlet runs through the front side and the back side of the water outlet part; a step part is fixedly provided with between the insertion plate and the movable plate, the step surface of the step part slides against the back of the water outlet part.

In an embodiment: when the movable plate is in the first position; the step surface of the step part closes the interval between the second outer side wall and the second inner side wall, and the step part is spaced from the first inner side wall; when the movable plate is located in the second position: the step surface of the step closes the interval between the first outer side wall and the first inner side wall, and the step part is spaced with the second inner side wall.

In an embodiment: the driving mechanism comprises a wheel body which can rotate under the action of water flow, the wheel body rotates in the shell part, and the wheel body and the movable plate are connected in rotation.

In an embodiment: the driving mechanism also includes an eccentric part, the movable plate is provided with a matching slot, the eccentric part adapts to connect the eccentric part and drives the movable plate to slide through the wheel body rotation.

The second technical scheme provided by the invention is as follows: A water outlet device includes a shell part, a movable plate and a driving mechanism. The shell part is provided with a water outlet part. The driving mechanism connects the movable plate to drive the movable plate to slide relative to the water outlet part; the water outlet part has a water outlet, and the water outlet has a first inner side wall and a second inner side wall; the movable plate is provided with an insertion part, which has a first outer side wall and a second outer side wall side wall, and the insertion part is inserted into the water outlet; the water outlet channel formed by the water outlet through the movable plate is changed from the interval between the first outer side wall and the first inner side wall to the interval between the second outer side wall and the second inner side wall.

The third technical scheme provided by the invention is as follows: A water outlet device includes a shell part, a movable plate and a driving mechanism. The shell part is provided with a water outlet part. The driving mechanism connects the movable plate to drive the movable plate to slide relative to the water outlet part; the water outlet part has a water outlet, the two inner side walls of the water outlet facing each other along the sliding direction of the movable plate are a first inner side wall and a second inner side wall, respectively; the movable plate is provided with an insertion part, the two outer side walls of the insertion part facing each other along the sliding direction of the movable plate are the first outer side wall and the second outer side wall, respectively, the insertion part is inserted into the water outlet; the first inner side wall structure and the first outer side wall structure are abuts against each other, and the second inner side wall structures and the second outer side wall structure are abuts against each other, and the distance between the first inner side wall and the second inner side wall in the sliding direction of the movable plate is greater than the outer side wall and a second outer side wall along the sliding direction of the movable plate.

The Beneficial Effects of the Present Invention Lie in:

The movable plate is located in the first position: the water outlet forms a first water outlet channel sandwiched between the first outer side wall and the first inner side wall; the movable plate is located in the second position: the water outlet forms a second water outlet channel sandwiched between the second outer side wall and the second inner side wall, that is to say, the movable plate circulation makes the outlet water from the first water outlet channel to the second water outlet channel circulate to produce mixed water spray.

The outlet angle of the first water outlet channel and the outlet angle of the second water outlet channel are different to produce left-right cross-spray.

DRAWINGS

DETAILED DESCRIPTION

Figure 1:
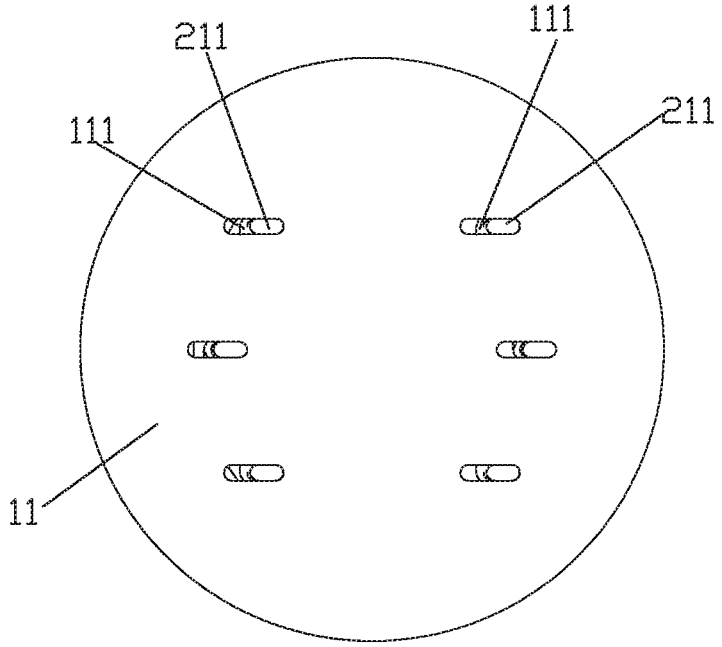
FIG. 1 is a bottom view of the water outlet device according to this specific embodiment.
Figure 2:
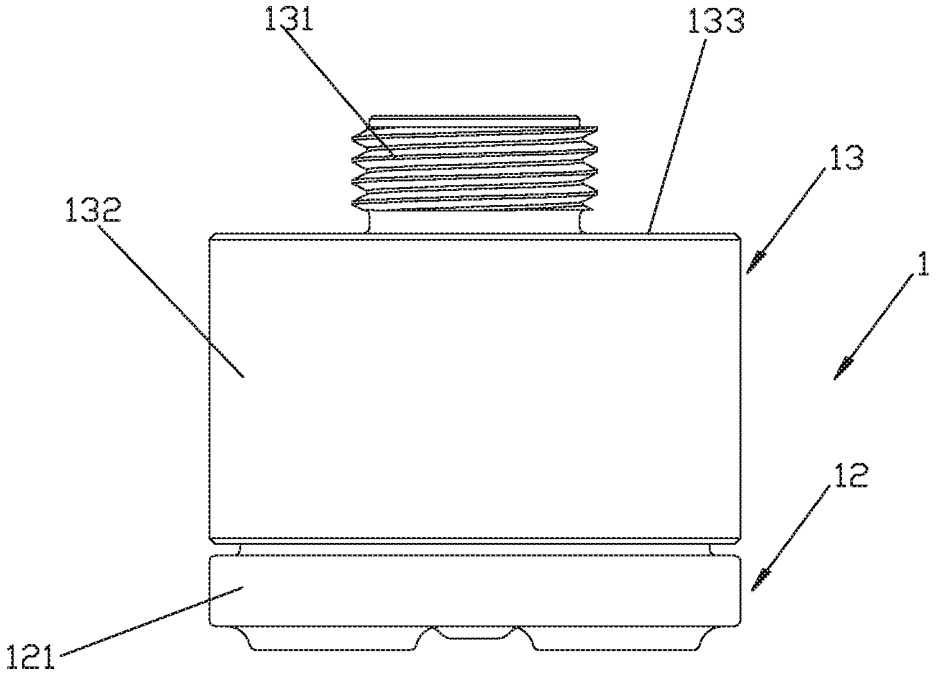
FIG. 2 is a main view of the water outlet device according to this specific embodiment.
Figure 3:
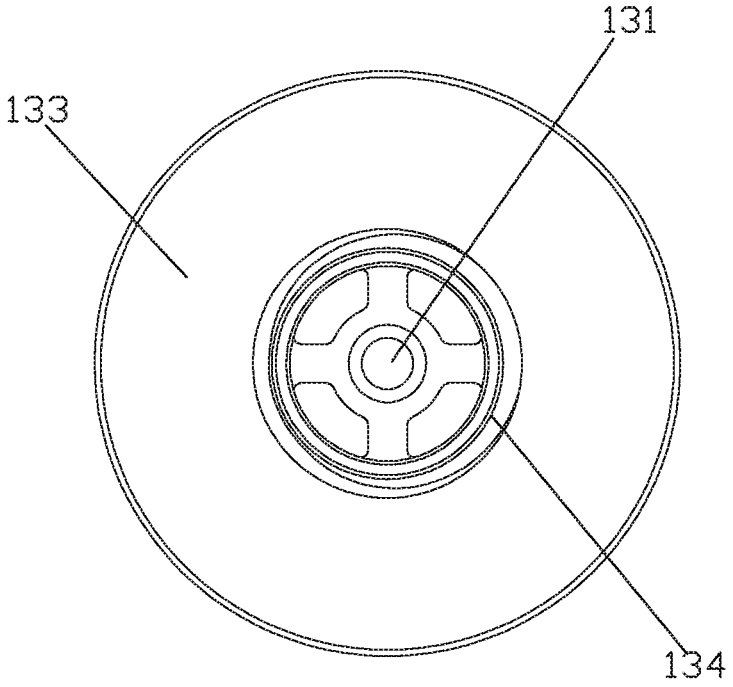
FIG. 3 is a top view of the water outlet device according to this specific embodiment.

Refer to FIGS. 1 to 12, water outlet device, including a shell part 1, a movable plate 2 and a driving mechanism 3. The shell part 1 is provided with a water outlet part 11. The driving mechanism 3 connects the movable plate 2 to drive movable plate 2 to slide between the first position and the second position relative to the water outlet part 11, for example, sliding along the left and right directions in the figure. The water outlet part 11 has a water outlet 111, which has a first inner side wall 112, a second inner side wall 113, a third inner side wall 114 and a fourth inner side wall 115. The movable plate 2 is provided with an insertion part 211, which has the first outer side wall 212, the second outer side wall 213, the third outer side wall 214, and the fourth outer side wall 215. The insertion part 211 is inserted into the water outlet 111. In the present specific embodiment: In the water outlet 111, the first inner side wall 112 and the second inner side wall 113 are disposed facing each other along the sliding direction of the movable plate 2, and the third inner side wall 114 and the fourth inner side wall 115 are disposed facing each other vertical to the sliding direction of the movable plate 2 (the front-back direction in the figure). However, it is not limited to this. According to the need, water outlet can have only three inner side walls, or five or six inner side walls, the insertion part 211 can have only three outer side walls, or five or six outer side walls.

Figure 4:
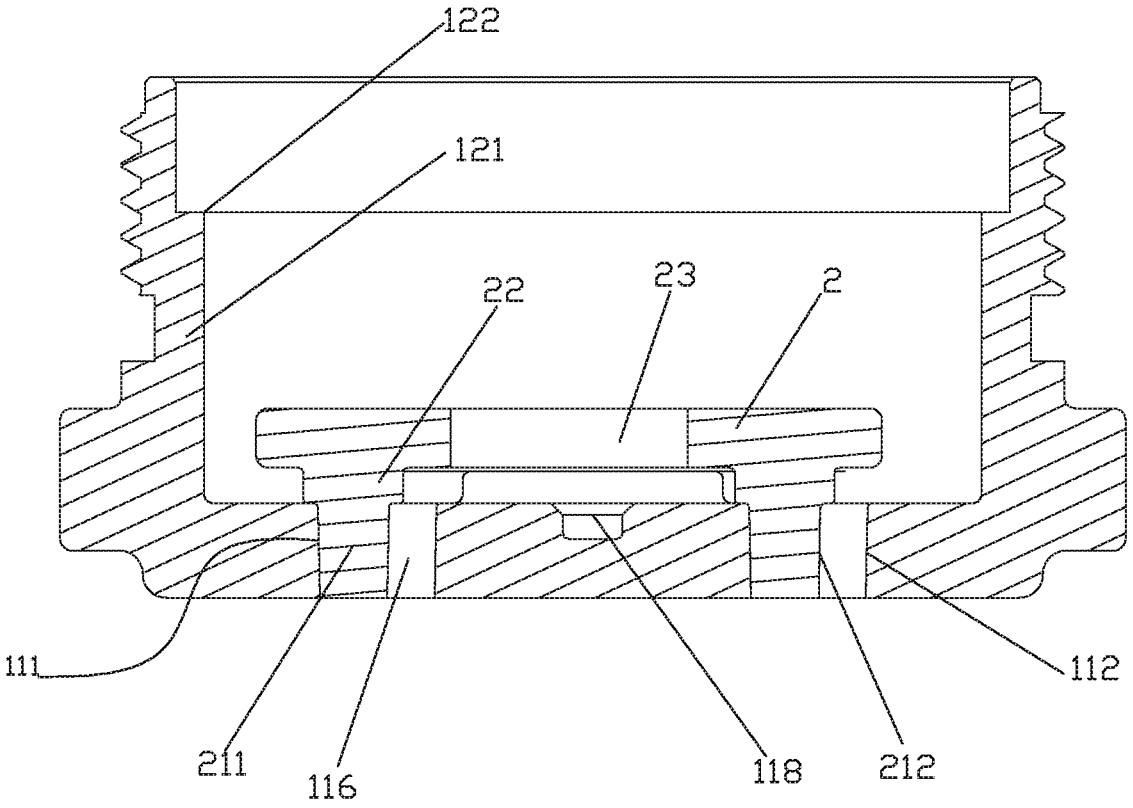
FIG. 4 is a profile of the lower shell and the movable plate in this specific implementation.
Figure 5:
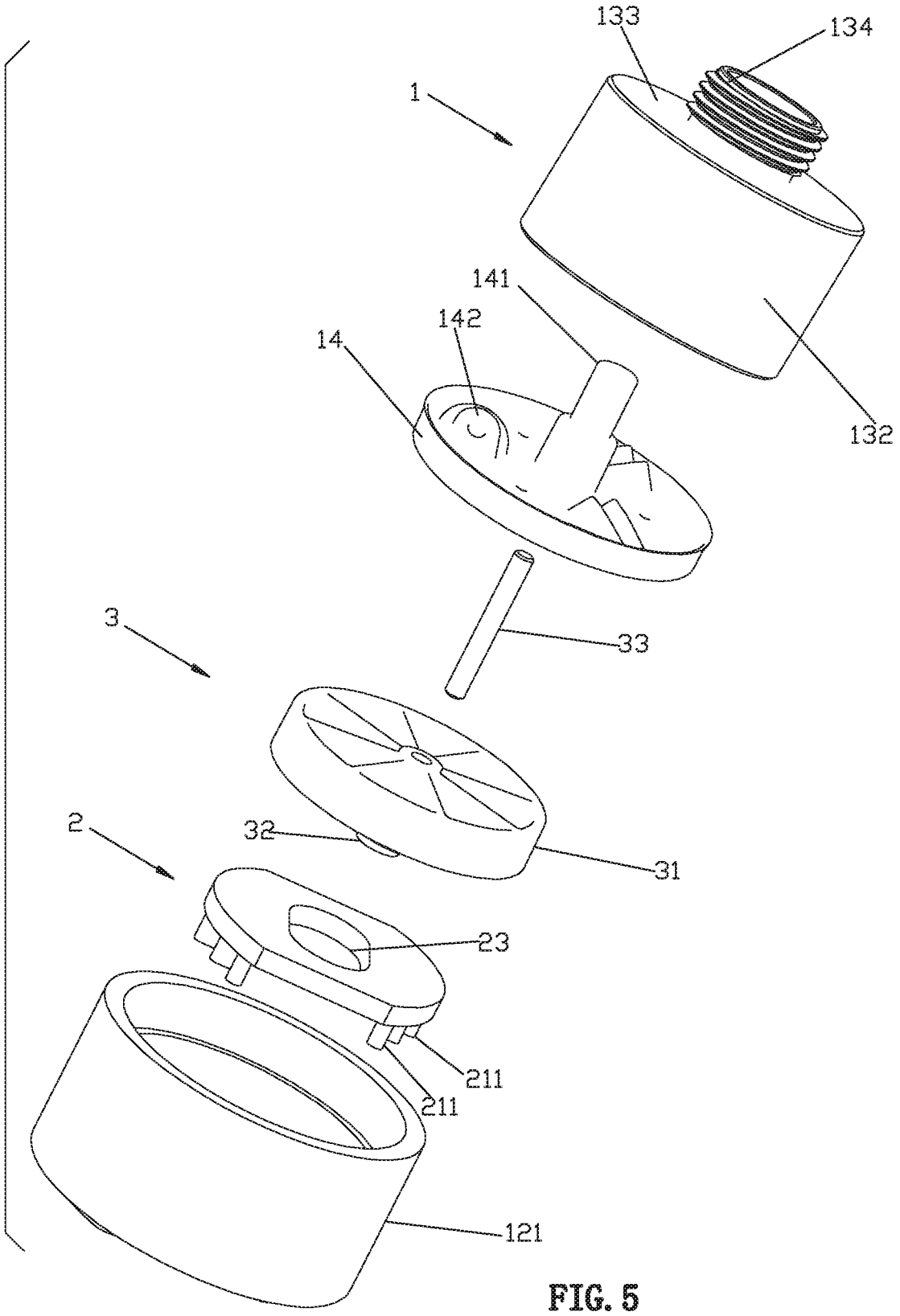
FIG. 5 is a three-dimensional decomposition diagram of the water outlet device according to this specific embodiment.
Figure 6:
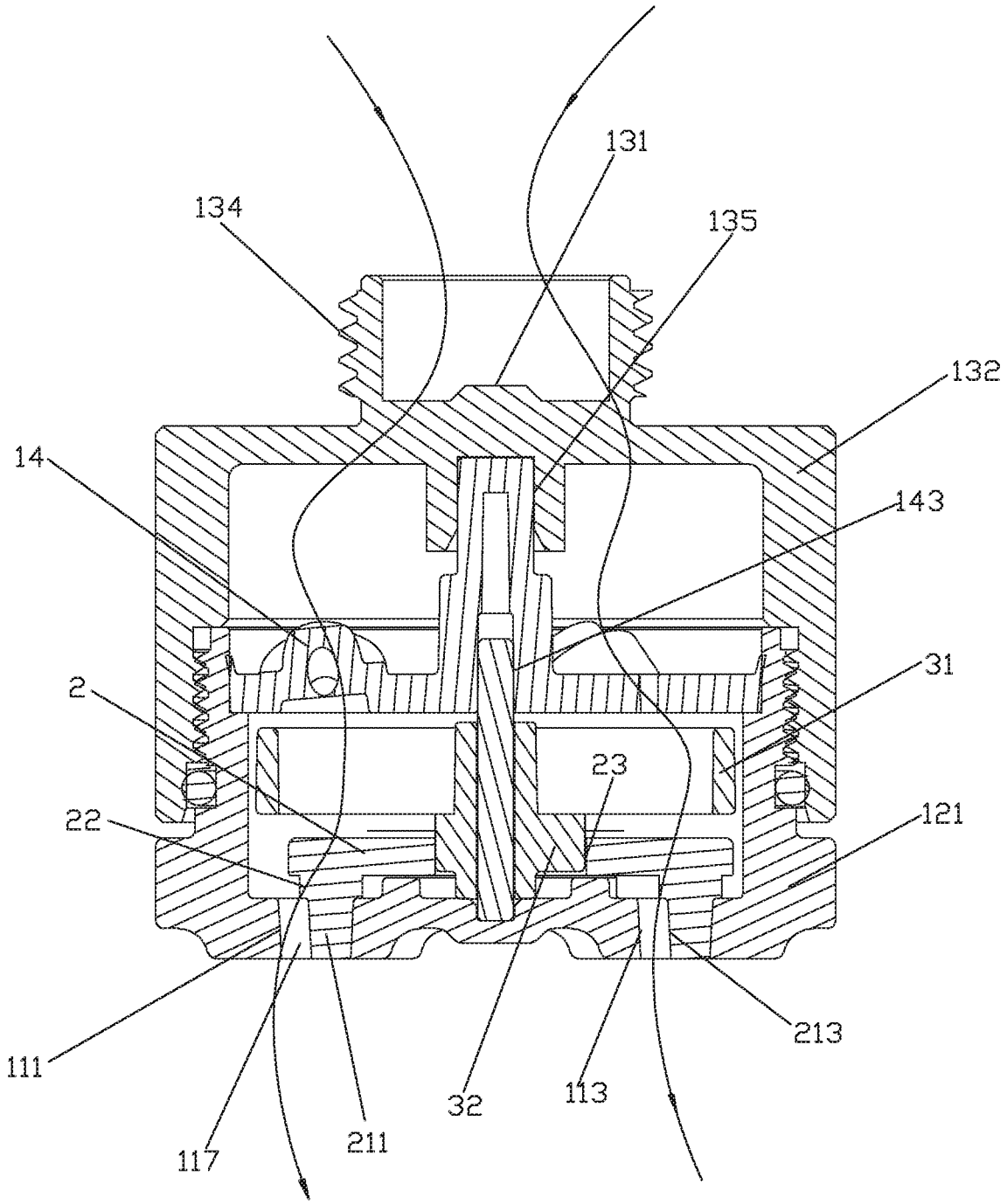
FIG. 6 is a cross-sectional view of the water outlet device according to this specific embodiment.
Figure 7:
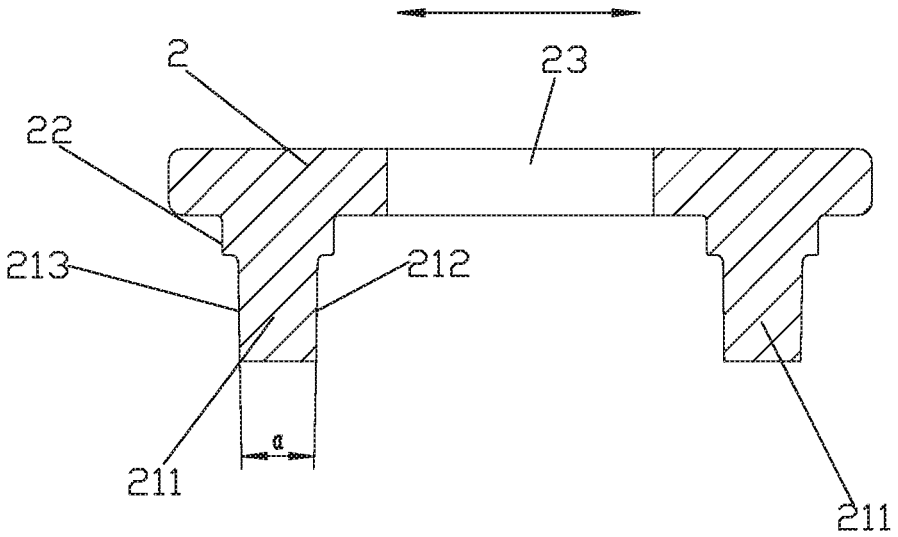
FIG. 7 is a cross-sectional view of the movable plate in this specific embodiment.
Figure 8:
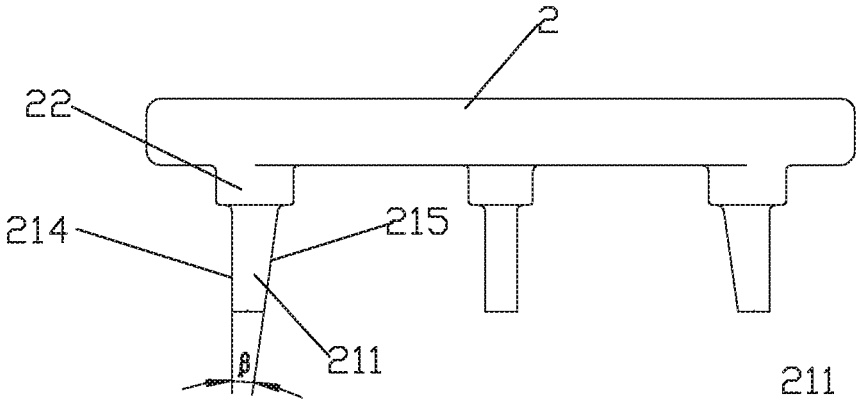
FIG. 8 is the main view of the movable plate in this specific implementation.
Figure 9:
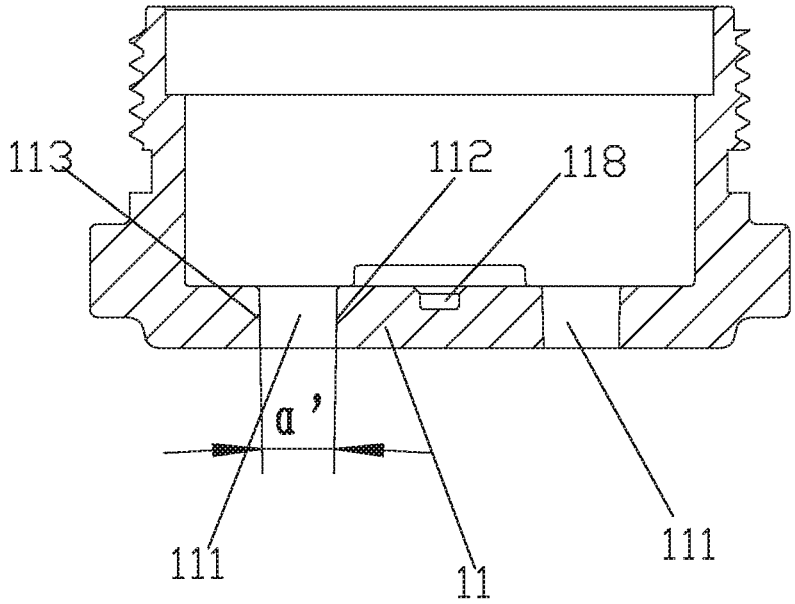
FIG. 9 is one of the cross-sectional view of the lower shell in this specific embodiment.
Figure 10:
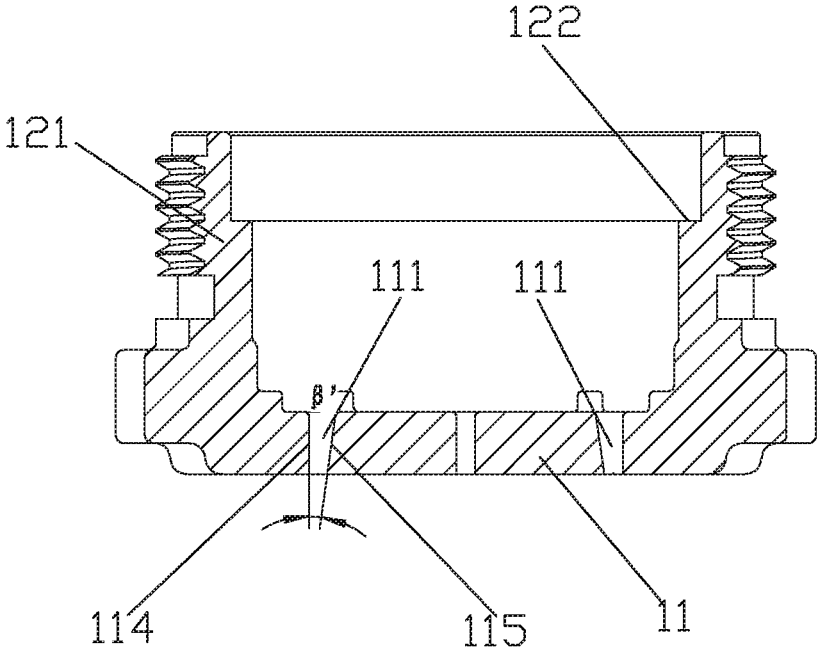
FIG. 10 is the second cross-sectional view of the lower shell in this specific embodiment.
Figure 11:
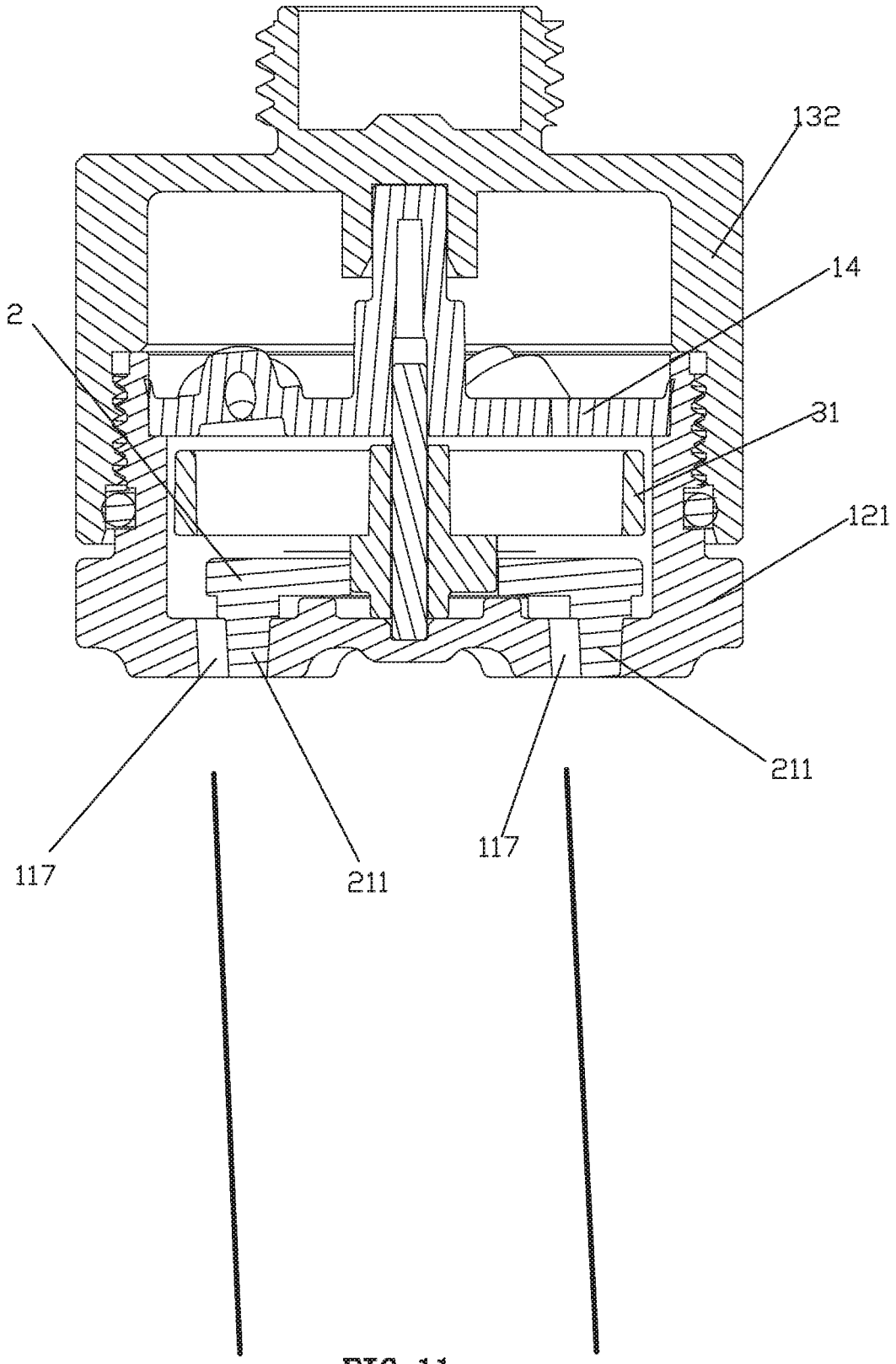
FIG. 11 is a schematic diagram of the discharging water of the first water outlet channel of the water outlet device in this specific embodiment.
Figure 12:
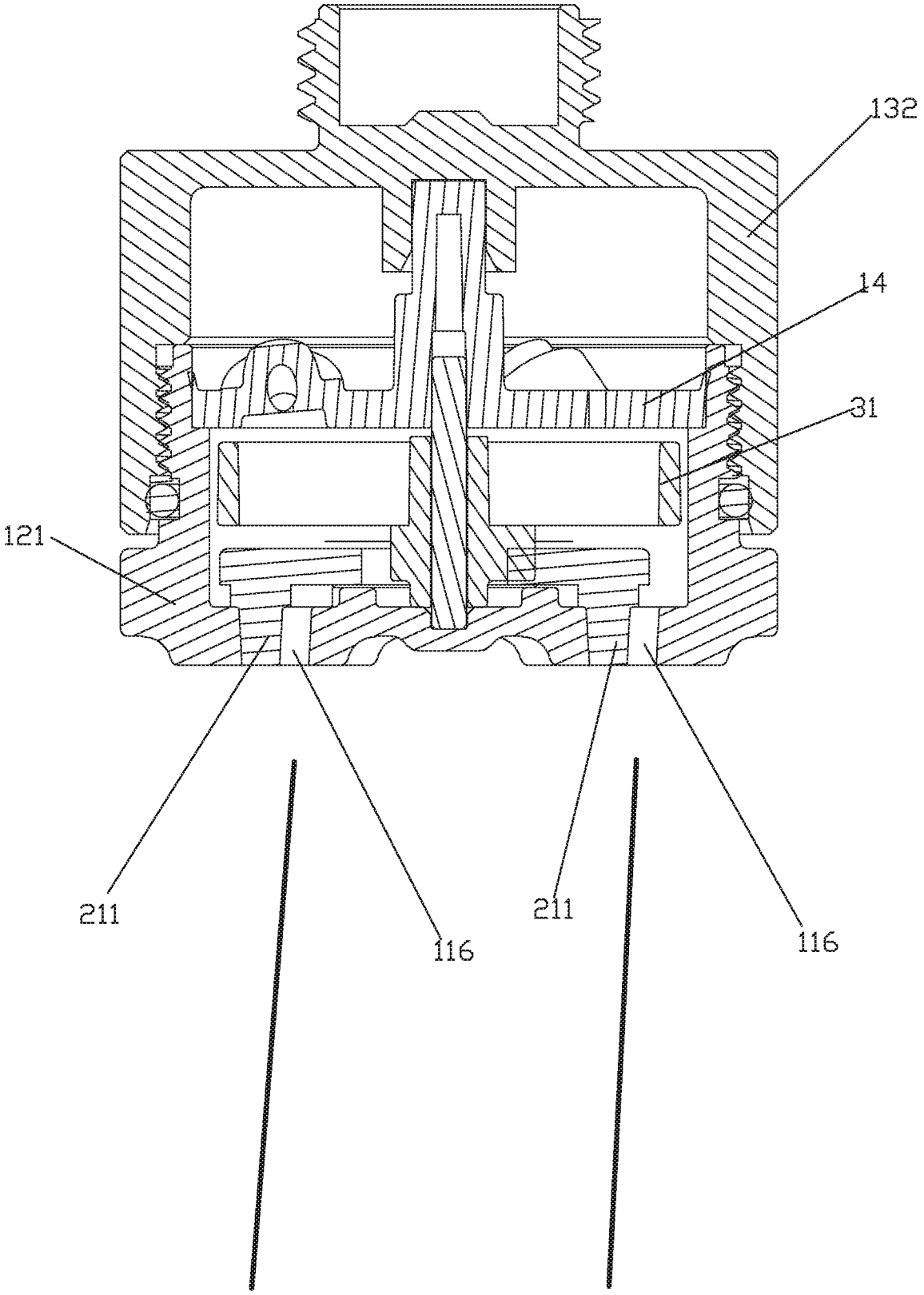
FIG. 12 is a schematic diagram of the discharging water of the second water outlet channel of the water outlet device in this specific embodiment.

Wherein:

Refer to FIGS. 4 and 12, the movable plate 2 is in the first position. The second outer side wall 213 and the second inner side wall 113 abuts against each other. The first outer side wall 212 and the first inner side wall 112 are parallel. The water outlet 111 forms the first water outlet channel 116 clamped between the first outer side wall 212 and the first inner side wall 112;

Please refer to FIGS. 6 and 11. A movable plate 2 is in the second position, the first outer side wall 212 and the first inner side wall 112 abuts against each other. The second outer side wall 213 and the second inner side wall 113 are parallel. The water outlet 111 forms a second water outlet channel 117 clamped between the second outer side wall 213 and the second inner side wall 113.

Figure 13:
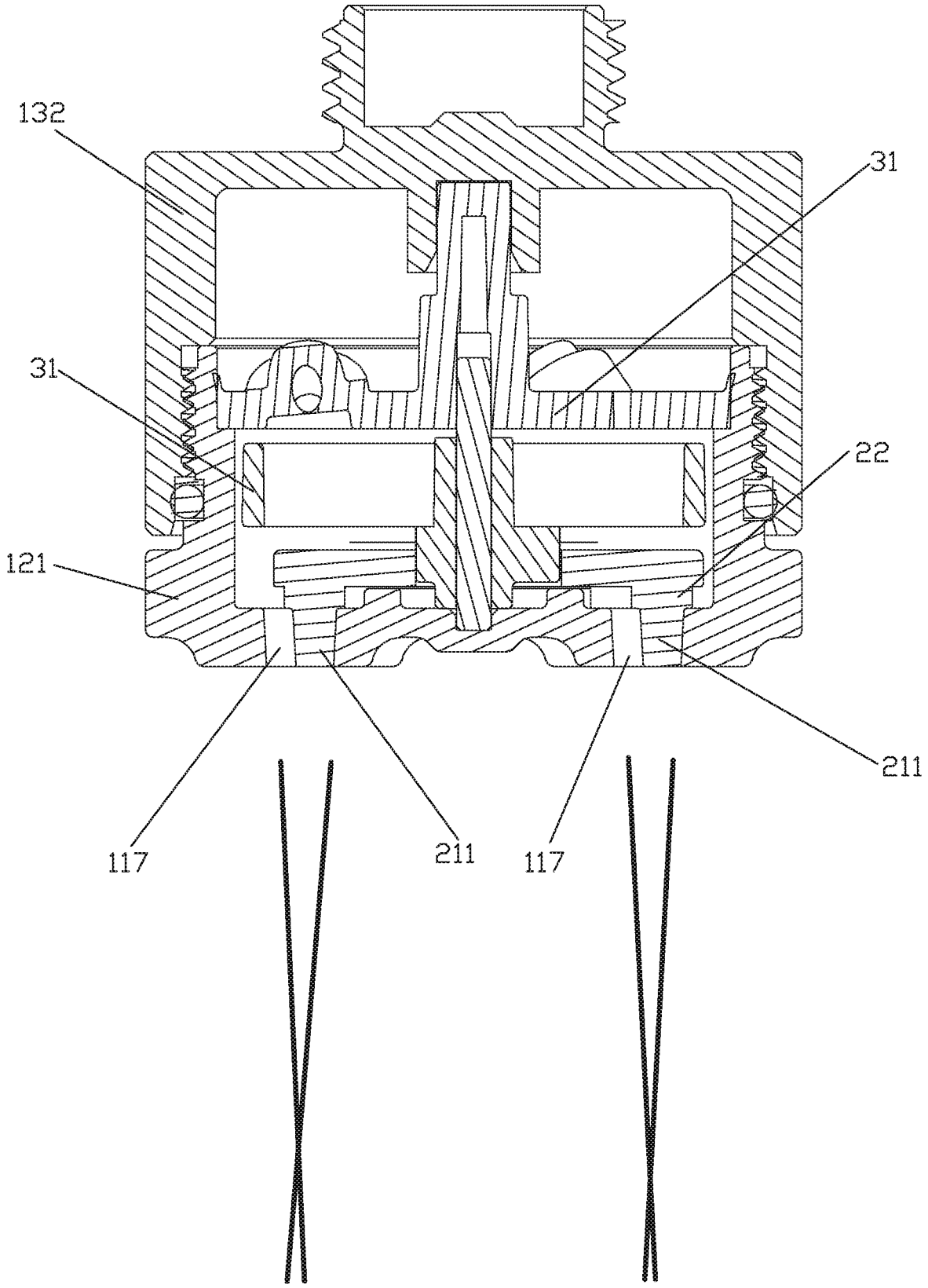
FIG. 13 is a diagram of the water discharging of the water outlet device according to this specific embodiment.

Moreover, the water outlet angle of the first water outlet channel 116 and the water outlet angle of the second water outlet channel 117 are different. Through the cyclic sliding of movable plate, the water cyclically changes from the first water outlet channel 116 to the second water outlet channel 117, and the water outlet device is discharging water as shown in FIG. 13 as the left and right cross-expansion type of water splash, which is a new way of water discharge, bringing different shower massage experience; Compared with traditional massage water, the impact frequency is slower, the sense of massage is more obvious, and the impact range is larger.

In the present specific embodiment: The first outer side wall 212 and the second outer side wall 213 cooperate to form an octagonal shape with large front and small back, like the two sides of the isosceles trapezoid, that is, the insertion part 211 is isosceles trapezoid along the left and right parts part. The first inner side wall 112 and the second inner side wall 113 cooperate to form an octagonal shape with large front and small back, like the two sides of the isosceles trapezoid, that is, an isosceles trapezoid along the left and right part of the water outlet 111. The angle between the first outer side wall and the movable plate sliding direction is 80-90 degrees, the angle between the second outer side wall and the movable plate sliding direction is 90-100 degrees, the angle between the first inner side wall and the movable plate sliding direction is 80-90 degrees, and the angle between the second inner side wall and the movable plate sliding direction is 90-100 degrees. The angle between the first outer side wall 212 and the second outer side wall 213 is 0-10 degrees, as a in figure, it is 1 degree, and the angle between the first inner side wall 112 and the second inner side wall 113 is 0-10 degrees, as a in figure.

In the present specific embodiment: The sliding direction of the water outlet perpendicular to the movable plate matches the sliding direction of the insertion part perpendicular to the movable plate, as follows: The third inner side wall 114 and the third outer side wall 214 are abutted against each other, while the fourth inner side wall 115 and the fourth outer side wall 215 are abutted against each other. The angle between the third inner side wall and the fourth inner side wall is 0-20 degrees. The angle between the third outer side wall and the fourth outer side wall is 0-20 degrees, as 13 in the figure, the angle is 8 degrees, the third inner side wall and the third outer side wall are vertically arranged, and the fourth inner side wall and the fourth outer side wall are inclined along the 13 angle.

The shell part 1 consists of a lower shell 12 and an upper shell 13. The lower shell 12 includes the above water outlet part 11 and the lower peripheral wall 121 extending upward from the peripheral edge of the water outlet part 11. The upper shell 13 includes a water inlet part 131, an upper peripheral wall 132, and a ring part 133 connected between the upper periphery of the upper peripheral wall 132 and the water inlet part 131. The upper peripheral wall 132 and lower peripheral wall 121 are fixed together, such as threaded connection, to form a water inlet cavity between the upper shell 13 and the lower shell 12, and the water inlet part 131 is connected to the water inlet cavity.

The water outlet part 11 has a back side and a front side, and the water outlet 111 runs through the front side and the back side of the water outlet part. A step part 22 is fixedly provided between the insertion plate 211 and movable plate 2, and the step surface of the step part 22 slides against the back of the water outlet part 11. wherein: when the movable plate is in the first position: the step surface of the step part closes the interval between the second outer side wall and the second inner side wall, and the step part is spaced from the first inner side wall, so that the water outlet cavity is connected to the first water inlet channel. When the movable plate is located in the second position: the step surface of the step closes the interval between the first outer side wall and the first inner side wall, and the step part is spaced with the second inner side wall so that the water outlet cavity is connected to the second water inlet channel According to the need, the flow area of the water inlet end of the water outlet can be controlled by adjusting the radial dimension of the step, so as to realize the flow regulation.

The driving mechanism 3 is installed in the water inlet cavity and includes a wheel body 31 which can rotate under the action of water flow. The wheel body 31 rotates in shell part 1. The driving mechanism 3 also includes eccentric part 32. The movable plate 2 is provided with a matching slot 23. The eccentric part adapts to connect the matching slot 23 through the wheel body rotating to drive the movable plate to slide. Preferably: the water inlet part 131 includes a center seat, an outer ring wall 134 and a number of spokes connecting the outer ring wall and the center seat. The ring part is connected between the outer ring wall and the upper peripheral wall. The bottom of the center seat is provided with the first connecting hole 135 in a concave way, and the inner side wall of the lower peripheral wall 121 also forms a step 122; An oblique water body 14 is further disposed, and a connecting shaft 141 is formed on the oblique water body 14. The upper end of the connecting shaft 141 is attached to the first connecting hole 135. The outer peripheral edge of the oblique water body 14 abuts on the step 122. The oblique water body 14 is provided with an oblique water hole 142; the wheel body 31 is a turbine, the water outlet part is provided with second connecting hole 118 on the back in a concave way, and a rotary shaft 33 is also provided. The lower end of the rotary shaft 33 is connected to the second connecting hole, and the upper end is connected to the third connecting hole 143 provided in a concave way on the bottom of the oblique water body 14. The turbine is located under the oblique water body, which makes the downstream flow of the oblique water hole 142 impact the turbine to drive the turbine to rotate. The eccentric part 32 is an eccentric wheel, the eccentric wheel is connected in the matching slot 23.

According to the need, a clutch mechanism can be provided to control whether the driving mechanism and the movable plate are driven or not. The clutch mechanism can be separated after controlling the movable plate to switch to the first position or the second position. Or, the clutch mechanism is always meshed to control the movable plate to cycle to produce the above spray.

The above is only a concrete embodiment of the present invention, but the design concept of the present invention is not limited to this. Any substantive modification of the present invention by using this concept shall be an act that infringes the scope of protection of the present invention.

The invention claimed is:

1. A water outlet device, comprising:

a shell part, and a movable plate, wherein:

the shell part is provided with a water outlet part, the movable plate is driven to slide relative to the water outlet part between a first position and a second position, the water outlet part comprises a water outlet, the water outlet comprises a first inner side wall and a second inner side wall, the movable plate is provided with an insertion part, the insertion part comprises a first outer side wall and a second outer side wall, the insertion part is disposed in the water outlet, the first outer side wall and the second outer side wall cooperate to form a tapered shape with a first front surface and a first back surface, an area of the first front surface is larger than an area of the first back surface, the first inner side wall and the second inner side wall cooperate to form a tapered shape with a second front surface and a second back surface, an area of the second front surface is larger than an area of the second back surface, when the movable plate is located at the first position, the water outlet forms a first water outlet channel sandwiched between the first outer side wall and the first inner side wall, and when the movable plate is located at the second position, the water outlet forms a second water outlet channel sandwiched between the second outer side wall and the second inner side wall.

2. The water outlet device according to claim 1, wherein:

two opposite inner side walls of the water outlet along a sliding direction of the movable plate define the first inner side wall and the second inner side wall respectively, and two opposite outer side walls of the insertion part along the sliding direction of the movable plate define the first outer side wall and the second outer side wall respectively.

3. The water outlet device according to claim 1, wherein:

when the movable plate is located at the first position, the second outer side wall abuts the second inner side wall, and when the movable plate is located at the second position, the first outer side wall abuts the first inner side wall.

4. The water outlet device according to claim 1, wherein a water outlet angle of the first water outlet channel is different from a water outlet angle of the second water outlet channel.

5. The water outlet device according to claim 1, wherein:

when the movable plate is located at the first position, the first outer side wall is parallel to the first inner side wall, and when the movable plate is located at the second position, the second outer side wall is parallel to the second inner side wall.

6. The water outlet device according to claim 1, wherein:

an angle between the first outer side wall and a sliding direction of the movable plate is 80-90 degrees, and an angle between the second outer side wall and the sliding direction of the movable plate is 90-100 degrees.

7. The water outlet device according to claim 1, wherein:

an angle between the first outer side wall and the second outer side wall is 0-10 degrees, and an angle between the first inner side wall and the second inner side wall is 0-10 degrees.

8. The water outlet device according to claim 1, wherein:

two opposite inner side walls of the water outlet perpendicular to a sliding direction of the movable plate define a third inner side wall and a fourth inner side wall respectively, and two opposite outer side walls of the insertion part perpendicular to the sliding direction of the movable plate define a third outer side wall and a fourth outer side wall respectively.

9. The water outlet device according to claim 8, wherein:

an angle between the third inner side wall and the fourth inner side wall is 0-20 degrees, and an angle between the third outer side wall and the fourth outer side wall is 0-20 degrees.

10. The water outlet device according to claim 8, wherein:

the third outer side wall is engaged with and abuts the third inner side wall, and the fourth outer side wall is engaged with and abuts the fourth inner side wall.

11. The water outlet device according to claim 1, wherein:

the water outlet part comprises a back side and a front side, the water outlet penetrates the front side and the back side of the water outlet part, a step part is fixedly provided between the insertion part and the movable plate, and a step surface of the step part slidably abuts the back side of the water outlet part.

12. The water outlet device according to claim 11, wherein:

when the movable plate is located at the first position:

the step surface of the step part closes an interval between the second outer side wall and the second inner side wall, and the step part is separated from the first inner side wall, and when the movable plate is located at the second position:

the step surface of the step part closes an interval between the first outer side wall and the first inner side wall, and the step part is separated from the second inner side wall.

13. The water outlet device according to claim 1, comprising:

a driving mechanism, wherein:

the driving mechanism is operatively connected to the movable plate, the driving mechanism comprises a wheel body configured to rotate due to water flow, the wheel body is rotatably disposed in the shell part, and the wheel body is rotatably connected to the movable plate.

14. The water outlet device according to claim 13, wherein:

the driving mechanism comprises an eccentric part, the movable plate is provided with a matching slot, and the eccentric part adapts to and is connected to the eccentric part and drives the wheel body to rotate to drive the movable plate to slide.

15. A water outlet device, comprising:

a shell part, and a movable plate, wherein:

the shell part is provided with a water outlet part, the movable plate is driven to slide relative to the water outlet part between a first position and a second position, the water outlet part comprises a water outlet, the water outlet comprises a first inner side wall and a second inner side wall, the movable plate is provided with an insertion part, the insertion part comprises a first outer side wall and a second outer side wall, the insertion part is disposed in the water outlet, the water outlet part comprises a back side and a front side, the water outlet penetrates the front side and the back side of the water outlet part, a step part is fixedly provided between the insertion part and the movable plate, a step surface of the step part slidably abuts the back side of the water outlet part, when the movable plate is located at the first position, the water outlet forms a first water outlet channel sandwiched between the first outer side wall and the first inner side wall, and when the movable plate is located at the second position, the water outlet forms a second water outlet channel sandwiched between the second outer side wall and the second inner side wall.

* * * * *